US007824735B2

(12) United States Patent
Chasser et al.

(10) Patent No.: US 7,824,735 B2
(45) Date of Patent: Nov. 2, 2010

(54) METHOD FOR SELECTIVELY COATING SUBSTRATES

(75) Inventors: Anthony M. Chasser, Allison Park, PA (US); Jennifer L. Thomas, Pittsburgh, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 12/113,971

(22) Filed: May 2, 2008

(65) Prior Publication Data

US 2009/0274882 A1 Nov. 5, 2009

(51) Int. Cl.
*B05D 1/32* (2006.01)

(52) U.S. Cl. ..... 427/259; 427/282; 427/202; 427/301; 427/302; 427/272

(58) Field of Classification Search ..... 427/259, 427/272, 282, 301, 302, 202
See application file for complete search history.

(56) References Cited

U.S. PATENT DOCUMENTS

| | | | | |
|---|---|---|---|---|
| 5,206,341 | A * | 4/1993 | Ibay et al. | 528/361 |
| 5,719,246 | A * | 2/1998 | Taniguchi et al. | 526/320 |
| 6,391,390 | B1 * | 5/2002 | Boisseau et al. | 427/385.5 |
| 6,773,746 | B1 * | 8/2004 | Bell | 427/154 |
| 2006/0141234 | A1 * | 6/2006 | Rearick et al. | 428/304.4 |

* cited by examiner

*Primary Examiner*—Frederick J Parker
*Assistant Examiner*—Alex Rolland
(74) *Attorney, Agent, or Firm*—Diane R Meyers

(57) ABSTRACT

Methods for selectively coating substrates are disclosed. The methods generally comprise applying acid to a portion of the substrate; coating the substrate with a coating comprising a component that reacts with the acid; and removing the coating from the portion of the substrate to which the acid has been applied.

15 Claims, No Drawings

METHOD FOR SELECTIVELY COATING SUBSTRATES

FIELD OF THE INVENTION

The present invention is directed to a method for selectively coating a substrate by applying an acid to a portion of the substrate.

BACKGROUND OF THE INVENTION

There are many industries in which it is desired to coat some, but not all, of a substrate, such as a substrate used in an article of manufacture. For example, one might desire to apply an accent color to certain portions of a substrate and/or article of manufacture. Another example would be painting a substrate that comprises a component having one color, and incorporating the component into an article of manufacture having one or more different colors. Selective application of coatings to a substrate, however, can be difficult and time-consuming. Selective application can be achieved, for example, by "masking" the portion of the substrate that is not to be coated, such as by application of tape or other shielding means that prevents the coating from being deposited on a portion of the substrate. Another method for selectively coating a substrate involves coating the entire substrate and then removing the coating from the desired area, such as when the coating has been partially cured. Both methods, however, are time-consuming, wasteful and costly. Improved methods for selectively coating a substrate are therefore desired.

SUMMARY OF THE INVENTION

The present invention is directed to a method for selectively coating a substrate comprising applying an acid to a portion of the substrate; coating the substrate with a coating comprising a component that reacts with the acid; and removing the coating from the portion of the substrate to which the acid has been applied.

DETAILED DESCRIPTION OF THE INVENTION

As noted above, the present invention is directed to methods of selectively coating a substrate. These methods generally comprise applying an acid to a portion of the substrate. That is, at least a portion of the substrate has an acid, such as a composition comprising an acid, applied thereto. A coating is then applied to some or all of the substrate; the coating comprises a component that reacts with the acid. "React(s)" as used in this context therefore can mean an actual chemical reaction yielding covalent bonds, as well as other interaction such as selective catalytic inhibition whereby the crosslinking mechanism simply will not occur under the low pH conditions induced by the microenvironment of where acid was applied. An example of when the covalent reaction would be impeded by the interaction of an acid would be a simple difunctional epoxy reaction (such as commercially available EPON 828, from Shell Chemical), with a difunctional acid (such as dodecanedioic acid ["DDDA"] from DuPont). One to one stoichiometry of these two components theoretically leads to infinite weight average molecular weight ("Mw") and virtual crosslinking. By manipulating the stoichiometry so as to use excess acid, Mw is greatly reduced, thereby resulting in poor crosslinking of the resultant film. An example of when catalytic inhibition would occur is the same EPON 828 reaction with DDDA. This reaction is base catalyzed and is very, very sluggish in acidic conditions. The acid on the surface of the substrate to be coated would neutralize any base catalyst added to the overlying coating, creating a salt, and therefore greatly impede the epoxy/acid reaction. The coating that has been applied to the portion of the substrate to which the acid has been applied can then be easily removed.

Any substrate can be coated according to the present invention. Suitable substrates can include, for example, metallic substrates and non-metallic substrates, including but not limited to polymeric substrates. In certain embodiments, the substrate comprises a flexible substrate. As used herein, the term "flexible substrate" refers to a substrate that can undergo mechanical stress, such as bending, stretching, compression and the like, without significant irreversible change. Examples of flexible substrates include fabrics, such as synthetic textiles, natural textiles, natural leathers, synthetic leathers, finished natural leathers, finished synthetic leathers, suede, vinyl, nylon, polyolefins and polyolefin blends, polyvinyl acetate and copolymers, polyvinyl chloride and copolymers, rubbers, urethane elastomers, cotton, polyester, wool, and acrylic. In certain embodiments, the flexible substrate is a compressible substrate. As used herein, the term "compressible substrate" means a substrate capable of undergoing a compressive deformation and returning to substantially the same shape once the compressive deformation has ceased. As used herein, the term "compressive deformation" means a mechanical stress that reduces the volume, at least temporarily, of a substrate in at least one direction. Compressible substrates can include various foam substrates, fluid-filled bladders, air-filled bladders or plasma-filled bladders. Oftentimes, compressible substrates temporarily deform as much as ≧50%, such as ≧70%, ≧75% or ≧80% of their original volume and return after stress along the deformation axis is removed. A coating on a compressible substrate would be expected to behave similarly.

As used herein, the term "foam substrate" means a polymeric and/or natural material that comprises a plurality of open and/or closed cells. Examples of foam substrates include polystyrene foams, polymethacrylamide foams, polyvinyl chloride foams, polyurethane foams, polypropylene foams, and polyethylene foams. Examples of olefinic foams include polypropylene, ethylene vinyl acetate (EVA) and polyethylene foams. Examples of polyurethane foams include thermoplastic urethane (TPU) foams.

According to the present invention, an acid is applied to at least a portion of the substrate; the acid should be applied to the portion of the substrate from which the coating will subsequently be applied and then removed. The acid can be applied by any means, such as by use of a paint brush, swab, and the like.

While any acid can be used according to the present invention, weak acids are especially suitable, particularly a protic or Bronsted acid. As will be appreciated by one skilled in the art, a weak acid falls into the pKa range between 1 and 6.9. Examples include acetic, propionic, formic, sulfonic and sulfonate esters like para toluene sulfonic acid, and carbonic and phosphoric acids. More particular compositions include those having the structure R—X(=)O—OH where R represents $C_{1-10}$ and where X=C,P,S. As noted above, the acid can be in the form of a composition comprising an acid. Compositions comprising an acid can include, for example, lemon juice, lime juice, vinegar, and the like, which comprise acetic acid. While any concentration of acid can be used, concentrations of less than 2M are particularly suitable.

Following application of the acid to at least a portion of the substrate, the substrate can then be dried, such as by air drying, or can be immediately coated. The coating applied to the substrate is one that comprises a component that reacts with the acid. For example, the coating can comprise an acid-functional resin that is crosslinkable with a suitable crosslinker, or can comprise an acid-functional crosslinker that reacts with a suitable resin. Specific examples include an acid-functional polyurethane resin crosslinkable with a suitable crosslinker, such as carbodiimides, hydroxyl alkyl amines, epoxies, aziridines and oxetanes. Other examples include an epoxy resin that is crosslinked with an acid crosslinker. The coating can be a one-component (1K) coating, wherein all of the coating components are stored together and cure is effected by heating or baking the coating. Alternately, the coating can be a two-component (2K) coating, or other multiple component coating, wherein the coating components are stored separately until just prior to application; such coatings can be air-dried at ambient temperature, forced air-dried or subjected to a relatively low cure temperature, for example.

A particularly suitable embodiment utilizes an acid-functional polyurethane resin, such as a waterborne acid-functional polyurethane resin. Any such resin known in the art can be used, such as that described in U.S. Pat. Nos. 6,765,057 or 6,599,977, incorporated in their entirety by reference herein. A particularly suitable crosslinker is a carbodiimide crosslinker. Suitable carbodiimide crosslinkers are commercially available from Nishimbo and Stahl, and are described in U.S. patent application Ser. No. 11/320,189 and U.S. Pat. Nos. 5,859,166; 6,127,477; and 6,248,819, incorporated in their entirety by reference herein.

It will be appreciated by those skilled in the art that the acid that is applied to the substrate first will "compete" with the acid-functional coating component. Thus, at least a portion of the moieties that react with acid functionality will react or otherwise interact with the acid instead of the acid functional coating component. As a result, this coating component will react with that acid instead of crosslinking with another coating component. Because the molecular weight of the reaction product between the acid and the component that reacts with the acid is relatively low, the crosslink density is relatively low. Thus, the adhesion between the coating and the substrate is also relatively low, and therefore the coating can be easily removed. Moreover, the low molecular weight of the final film on the portion of the substrate to which the acid is applied will allow it to behave more like a thermoplastic material instead of a thermoset material; one skilled in the art will recognize quickly the ease of removing thermoplastic materials, which are much more soluble in a variety of solvents. The use of an acid solution having a concentration of less than 2M will typically result in a lower molecular weight film than if an acid having a higher concentrate is used.

Following application of the coating, the coating can undergo any type of cure and/or any level of cure prior to removal of the desired portions of the coating. For example, the coated substrate can be ambient cured, forced air dried, or undergo a bake at a suitable temperature and for a suitable time based upon the type of coating used. In certain embodiments, the coating is a 2K coating comprising an acid-functional polyurethane resin in one component and a carbodiimide crosslinker in the other component, and the coating is cured at 100-140° F. for 15 to 25 minutes.

The coating can then be removed from those portions of the substrate to which the acid was applied. Removal can be effected by any means. For example, the coating can be manually peeled off. Alternatively, the coating can be wiped off, such as by use of a solvent. When using a solvent, an appropriate solvent should be selected so as to be innocuous to the cured coating that is not to be removed. A suitable solvent can include, for example, methyl ethyl ketone (MEK), MIBK, IPA, acetone, NMP, butyl carbitol, butyl cellosolve, butyl cellosolve acetate, halogenated solvents like methylene chloride and even detergents dissolved in water. Removal can be done at any time. In certain embodiments, removal is done almost immediately following the coating stage. In other embodiments, one can wait hours, days, or weeks, such as up to one month, before the coating is removed.

It has been surprisingly discovered that the methods of the present invention allow for easy removal of the coating that is not desired, while providing good adhesion between the substrate and the coating that is not to be removed. Therefore, although a step is added, namely the application of the acid, the overall time savings in comparison with methods known in the art for selectively coating a substrate is significant as the masking of the parts is the difficult manufacturing step. Accordingly, a substrate can be coated in accordance with the present invention in areas of the substrate where, for example, a particular color or colors are desired on the substrate, color accenting is desired on the substrate, and the like. Moreover, coating can be removed from an area of a substrate that is a component in an article of manufacture, for example, when the coating may otherwise interfere with the adhesion between the substrate and another substrate used in the article of manufacture and/or wherein a certain look is desired in the article of manufacture. The present invention is not limited to colors, basecoats, primers or clearcoats, water or solvent borne chemistries. Any chemistry using acid moieties as a portion of the cure can be used.

In one particular embodiment, the article of manufacture can comprise footwear. As used herein, the term "footwear" includes men's, women's and children's shoes, including athletic and support shoes, dress shoes, casual shoes, sandals, including flip-flops, boots, including work boots, outdoor footwear, orthopedic shoes, slippers and the like. Thus, the substrate coated according to the present invention can be a footwear component; as used herein, the term "footwear component" includes any part or portion of footwear. The footwear component can comprise a flexible substrate, such as a compressible substrate. Example footwear components include soles, midsoles, upper materials and liners. Midsoles and soles can comprise ethylene vinyl acetate foams, TPU foams, polymeric bladders filled with plasma, water or other fluid, such as nitrogen or air, and the like.

As used herein, unless otherwise expressly specified, all numbers such as those expressing values, ranges, amounts or percentages may be read as if prefaced by the word "about", even if the term does not expressly appear. Also, any numerical range recited herein is intended to include all sub-ranges subsumed therein. "Including" and like terms are open ended; that is, they mean "including but not limited to". Singular encompasses plural and vice versa. For example, although reference is made herein to "an" acid, "a" coating comprising "a" component that reacts with the acid, "a" substrate and the like, one or more of each of these and any other components can be used. As used herein, the term "polymer" refers to oligomers and both homopolymers and copolymers, and the prefix "poly" refers to two or more.

EXAMPLES

The following examples are intended to illustrate various aspects of the invention, and are not intended to limit the scope of the invention in any way. An example of an acid functional, waterborne coating with a carbodiimide crosslinker is shown below:

| Ingredients | Equivalent Wt (as supplied) | Amount |
|---|---|---|
| BAYHYDROL 110 (acid-functional polyurethane prepolymer commercially available from Bayer) | 2200 | 100 g |
| CARBODIILITE V 02 L2 (carbodiimide functional prepolymer commercially available from Nishimo Chemical) | 1100 | 50 g |

Stoichiometry is 1:1.
Simplified above formula represents the "control paint" as outlined below.

The above coating was applied either directly to an EVA substrate, or to an EVA substrate to which a portion had been applied either glacial acetic acid, lime juice, or white vinegar. The acids had previously been applied with a swab, and the paint applied within 30 minutes of the acid application. The coating was cured for 10-20 minutes at 140° F. The coating applied to that portion of the EVA substrate treated with acid was removed by rubbing with a cloth soaked in MEK. Lack of chemical resistance is shown by lack of solvent resistance or lower MEK rubs. The results are shown in the following table:

| | EVA Adhesion | MEK Rubs on EVA | Polyurethane Adhesion | MEK Rubs on Polyurethane |
|---|---|---|---|---|
| Control Paint | 5B | +100 No Scuffing | 5B | +100 No Scuffing |
| Control Paint over Glacial Acetic Acid | 1B | 20 Double Rubs | 1B | 20 Double Rubs |
| Control Paint over Lime Juice | 1B | 30 Double Rubs | 1B | 30 Double Rubs |
| Control Paint over White Vinegar | 1B | 25 Double Rubs | 1B | 25 Double Rubs |

[Adhesion is tape adhesion ASTM D 3359.]

As can be seen from the above table, solvent resistance and adhesion are significantly reduced when the coating is applied over the acid. This allows for easy removal of the coating in the areas where acid is applied.

Whereas a particular embodiment of this invention has been described above for purposes of illustration, it will be evident to those skilled in the art that numerous variations of the details of the present invention may be made without departing from the invention as defined in the appended claims.

The invention claimed is:

1. A method for selectively coating a substrate comprising:

a) applying an acid to a portion of the substrate, wherein said acid comprises,
R—C(O)—OH, where R represents a $C_1$-$C_{10}$ group, formic acid, carbonic acid, sulfonic acids, and/or phosphoric acids;

b) coating the substrate with a coating comprising a component that reacts with the acid; and c) removing the coating from the portion of the substrate to which the acid has been applied.

2. The method of claim 1, wherein the method further comprises the step of at least partially curing the coating applied in Step b) prior to the removal of Step c).

3. The method of claim 1, wherein the substrate comprises a flexible substrate.

4. The method of claim 3, wherein the flexible substrate comprises a compressible substrate.

5. The method of claim 4, wherein the compressible substrate comprises ethylene vinyl acetate foam.

6. The method of claim 4, wherein the compressible substrate comprises thermoplastic urethane.

7. The method of claim 4, wherein the compressible substrate comprises a polymeric bladder.

8. The method of claim 1, wherein the said acid comprises acetic acid.

9. The method of claim 1, wherein the coating comprises an acid-functional polyurethane resin and a crosslinker therefor.

10. The method of claim 9, wherein the crosslinker comprises carbodiimide.

11. The method of claim 1, wherein the coating comprises an epoxy resin and an acid-functional crosslinker.

12. The method of claim 1, wherein removal is effected by peeling the coating from the portion of the substrate to which the acid has been applied.

13. The method of claim 1, wherein removal of the coating from the portion of the substrate to which the acid has been applied is effected by wiping the substrate with a solvent.

14. The method of claim 13, wherein the solvent comprises methyl ethyl ketone.

15. The method of claim 1, wherein said acid comprises formic acid, propionic acid and/or para toluene sulfonic acid.

* * * * *